US009222157B2

(12) United States Patent
Kim et al.

(10) Patent No.: US 9,222,157 B2
(45) Date of Patent: Dec. 29, 2015

(54) HIGH-CARBON IRON-BASED AMORPHOUS ALLOY USING MOLTEN PIG IRON AND METHOD OF MANUFACTURING THE SAME

(75) Inventors: Sang-Won Kim, Pohang-si (KR); Gab-Sik Byun, Pohang-si (KR); Young-Geun Son, Pohang-si (KR); Eon-Byeong Park, Pohang-si (KR); Sang-Hoon Yoon, Seoul (KR); Sang-Wook Ha, Pohang-si (KR); Oh-Joon Kwon, Pohang-si (KR); Seung-Dueg Choi, Pohang-shi (KR); Seong Hoon Yi, Daegu (KR)

(73) Assignees: POSCO, Pohang-Si (KR); RESEARCH INSTITUTE OF INDUSTRIAL SCIENCE & TECHNOLOGY, Pohang-Si (KR)

( * ) Notice: Subject to any disclaimer, the term of this patent is extended or adjusted under 35 U.S.C. 154(b) by 309 days.

(21) Appl. No.: 13/817,930

(22) PCT Filed: Jun. 27, 2011

(86) PCT No.: PCT/KR2011/004680

§ 371 (c)(1),
(2), (4) Date: Feb. 20, 2013

(87) PCT Pub. No.: WO2012/023701

PCT Pub. Date: Feb. 23, 2012

(65) Prior Publication Data

US 2013/0146185 A1 Jun. 13, 2013

(30) Foreign Application Priority Data

Aug. 20, 2010 (KR) ..... 10-2010-0080610

(51) Int. Cl.
*C22C 45/02* (2006.01)
*C21D 5/00* (2006.01)

(52) U.S. Cl.
CPC .. *C22C 45/02* (2013.01); *C21D 5/00* (2013.01)

(58) Field of Classification Search
None
See application file for complete search history.

(56) References Cited

U.S. PATENT DOCUMENTS

| | | | | |
|---|---|---|---|---|
| 3,856,513 | A * | 12/1974 | Chen et al. | 148/403 |
| 4,400,208 | A * | 8/1983 | Ackermann | 148/403 |
| 5,322,113 | A | 6/1994 | Shibuya et al. | |
| 7,704,450 | B2 | 4/2010 | Takeuchi et al. | |
| 7,815,753 | B2 | 10/2010 | Yi et al. | |
| 2007/0295429 | A1 * | 12/2007 | Yi et al. | 148/403 |
| 2012/0167717 | A1 | 7/2012 | Yi et al. | |

FOREIGN PATENT DOCUMENTS

| | | | |
|---|---|---|---|
| CN | 101061246 | A | 10/2007 |
| JP | 05059483 | A | 3/1993 |
| KR | 1020030078723 | A | 10/2003 |
| KR | 1020060056783 | A | 5/2006 |
| KR | 1020100078316 | A | 7/2010 |

* cited by examiner

*Primary Examiner* — George Wyszomierski
(74) *Attorney, Agent, or Firm* — The Webb Law Firm

(57) ABSTRACT

Provided is an iron-based amorphous alloy and a method of manufacturing the same.
More particularly, provided is an high carbon iron-based amorphous alloy expressed by a general formula $Fe\alpha C\beta Si\gamma BxPyCrz$, wherein α, β, γ, x, y and z are atomic % of iron (Fe), carbon (C), silicon (Si), boron (B), phosphorus (P), and chrome (Cr) respectively, wherein α is expressed by $\alpha = 100-(\beta+\gamma+x+y+z)$ atomic %, β is expressed by 13.5 atomic % ≤ β ≤ 17.8 atomic %, γ is expressed by 0.30 atomic % ≤ γ ≤ 1.50 atomic %, x is expressed by 0.1 atomic % ≤ x ≤ 4.0 atomic %, y is expressed by 0.8 atomic % ≤ y ≤ 7.7 atomic %, and z is expressed by 0.1 atomic % ≤ z ≤ 3.0 atomic %.

6 Claims, 10 Drawing Sheets

HIGH-CARBON IRON-BASED AMORPHOUS ALLOY USING MOLTEN PIG IRON AND METHOD OF MANUFACTURING THE SAME

CROSS-REFERENCE TO RELATED APPLICATION

This application claims priority to and the benefit of Korean Patent Application No. 10-2010-0080610 filed in the Korean Intellectual Property Office on Aug. 20, 2010, the entire contents of which are incorporated herein by reference.

BACKGROUND OF THE INVENTION (a) Field of the Invention

The present invention relates to an iron-based amorphous alloy and a method of manufacturing the same. More particularly, the present invention relates to a low-priced high-carbon iron-based amorphous alloy using molten pig iron and a method of manufacturing the same.

(b) Description of the Related Art

An amorphous alloy refers to an alloy having an irregular (amorphous) atomic structure like liquid.

In the amorphous alloy, when metal is quenched in a molten state, in the case where the metal is cooled at high speed of no less than a critical cooling rate, since there is no time to regularly arrange atoms to be crystallized, irregular atomic arrangement in a liquid state is maintained to a solid state.

That is, in liquid cooled at higher speed than the critical cooling speed, the viscosity of the liquid is significantly increased in a supercooled liquid region of no more than an equilibrium melting point so that fluidity of atoms in the liquid is significantly reduced. Therefore, the atoms that lose fluidity at very high cooling speed are fixed in a non-equilibrium phase structure so that characteristics of a solid state are represented. An alloy having the above-described structure is referred to as an amorphous alloy.

Due to such structural characteristics of the amorphous alloy, a material having an amorphous structure represents physical, chemical, and mechanical characteristics different from those of a conventional crystalline phase. For example, the amorphous alloy represents excellent characteristics such as high strength, a low friction coefficient, high corrosion resistivity, excellent soft magnetism, and superconductivity in comparison with a common metal alloy. Therefore, the amorphous alloy as a structural and functional material has high probability with engineering applications.

Earlier studies on the amorphous alloy relate to an Au—Si alloy of eutectic composition. It is confirmed that a metal amorphous phase is formed when Au—Si liquid of such eutectic composition is quenched. After that, many researchers have conducted studies about structure and physical properties of the metal amorphous material.

The amorphous alloy is very strong elasticity and has a yield stress close to a theoretical strength, and low electric and thermal conductivity and high magnetic permeability and low coercive force. Moreover, the amorphous alloy has features of high corrosion resistance and low damping phenomenon as a medium for sound wave propagation.

It is known that the amorphous alloy has economic benefits in energy, capital, and time for the manufacturing process.

However, during the manufacturing of the amorphous alloy from liquid, in order to suppress nucleation and growth between a melting point and glass transition temperature, a sufficient cooling rate (higher than 105 to 106 K/s) is required. For these reasons, there is restriction (less than 60 μm) for thickness when manufacturing the amorphous alloy.

Therefore, the amorphous alloy is manufactured by methods of enabling a rapid quenching, such as a gas atomization method, a drop tube method, a melt spinning method, and a splat quenching method.

As such, when the amorphous alloy is manufactured by the rapid quenching method, the amorphous alloy is inevitably manufactured as one- or two-dimensional specimen of easily radiating heat such as in the form of powder, ribbon, and a thin plate. However, recently applicability as high functionality and structural metal material employing features of the amorphous alloy is required. The amorphous alloy to be used as described above gradually needs excellent glass forming ability, ability of forming amorphous phase even at a lower threshold quenching rate, and possibility of being manufactured and in bulk.

Meanwhile, iron-based amorphous alloy is usually used as a magnetic material for decades and active researches for application of the same as a high functional structural material are conducted.

However, the existing iron-based amorphous alloys are made of high priced and high purified raw material with rare impurities through a carbon and impurity removing process by considering the glass forming ability or have a large amount of high priced elements, and it is hard to manufacture the iron-based amorphous alloys in bulk.

For these reasons, since the existing iron-based amorphous alloys are made accurately under the special atmosphere such as a vacuum state, an argon (Ar) gas atmosphere, etc., in the event when price of raw material increases and when to melt and cast the raw material and manufacturing costs are high, there are many problems in industrial product of the existing iron-based amorphous alloys.

Therefore, for the substantial industrial application of the useful properties of the amorphous alloys, it is required to develop an iron-based amorphous alloy which can be mass-produced by economic raw material.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a high-carbon iron-based amorphous alloy and a method of manufacturing the same having advantages of using molten pig iron.

An exemplary embodiment of the present invention provides an amorphous alloy made of economic raw material and manufactured in mass production. Another embodiment of the present invention provides a method of manufacturing a high-carbon iron-based amorphous alloy with economic raw material in mass production.

An exemplary embodiment of the present invention provides an high carbon iron-based amorphous alloy expressed by a general formula $Fe_{\alpha}C_{\beta}Si_{\gamma}B_{x}P_{y}Cr_{z}$, wherein α, β, γ, x, y and z are atomic % of iron (Fe), carbon (C), silicon (Si), boron (B), phosphorus (P), and chrome (Cr) respectively, wherein α is expressed by $\alpha=100-(\beta+\gamma+x+y+z)$ atomic %, (β is expressed by 13.5 atomic $\%\leq\beta\leq$17.8 atomic %, γ is expressed by 0.30 atomic $\%\leq\gamma\leq$1.50 atomic %, x is expressed by 0.1 atomic $\%\leq x\leq$4.0 atomic %, y is expressed by 0.8 atomic $\%\leq y\leq$7.7 atomic %, and z is expressed by 0.1 atomic $\%\leq z\leq$3.0 atomic %.

The high carbon iron-based amorphous alloy is manufactured using molten pig iron produced by a blast furnace of an iron making process in a steel mill as it is.

In this case, the molten pig iron preferably has content of carbon (C) of at least 13.5 atomic %. More preferably, the molten pig iron contains iron (Fe) of 80.4 atomic %≤Fe≤85.1 atomic %, carbon (C) of 13.5 atomic %≤C≤17.8 atomic %, silicon (Si) of 0.3 atomic %≤Si≤1.5 atomic %, phosphorus (P) of 0.2 atomic %≤P≤0.3 atomic %.

The high carbon iron-based amorphous alloy is any one of a ribbon shape, bulk, and powder.

Another exemplary embodiment of the present invention provides a method of manufacturing a high carbon iron-based amorphous alloy including: i) preparing molten pig iron containing carbon (C) of at least 13.5 atomic %; ii) adding at least one of Fe—Si alloy iron, Fe—B alloy iron, Fe—P alloy iron and Fe—Cr alloy iron into the molten pig iron to melt; iii) preparing the molten pig iron where the alloy iron is melted to have composition expressed by the following general formula; and (a general formula is expressed by FeαCβSiγBxPyCrz, where α, β, γ, x, y and z are respective atomic % of iron (Fe), carbon (C), silicon (Si), boron (B), phosphorus (P) and chrome (Cr), wherein α is expressed by α=100−(β+γ+x+y+z) atomic %, β is expressed by 13.5 atomic %≤17.8 atomic %, β is expressed by 0.30 atomic %≤γ≤1.50 atomic %, x is expressed by 0.1 atomic %≤x≤4.0 atomic %, y is expressed by 0.8 atomic %≤y≤7.7 atomic % and z is expressed by 0.1 atomic %≤z≤3.0 atomic %) iv) rapidly quenching the prepared molten pig iron.

In this case, the molten pig iron preferably contains iron (Fe) of 80.4 atomic %≤Fe≤85.1 atomic %, carbon (C) of 13.5 atomic %≤C≤17.8 atomic %, silicon (Si) of 0.3 atomic %≤Si≤1.5 atomic %, phosphorus (P) of 0.2 atomic %≤P≤0.3 atomic %.

The molten pig iron may be melted again after quenching and may be rapidly quenched into an amorphous alloy.

Moreover, the rapidly quenching may be carried out by one of rapidly quenching a mold directly, a melt spinning, and an atomizing method. The high carbon iron-based amorphous alloy manufactured as described above is any one of a ribbon shape, bulk, and powder.

The iron-based amorphous alloy according to exemplary embodiments of the present invention is manufactured using molten pig iron containing carbon of high concentration (more than 13.5 atomic %) which is mass-produced by a blast furnace in an integrated steel mill without a steel making process.

Moreover, the iron-based amorphous alloy according to exemplary embodiments of the present invention has a low threshold quenching rate and an excellent glass forming ability and exhibits remarkable decrease of the glass forming ability due to impurities, so that an iron-based amorphous alloy enabling to manufacture the amorphous alloy even using alloy irons (Fe—B, Fe—P, Fe—Si, and Fe—Cr) used in a usual steel mill is provided.

Moreover, the iron-based amorphous alloy according to exemplary embodiments of the present invention uses the maximum amount of low priced molten pig iron by maintaining average concentration of carbon in the produced alloy to at least 13.5 atomic % and by adding high priced boron and phosphorus to maintain glass forming ability corresponding to that of existing alloys, and to guaranteeing economic benefit.

DETAILED DESCRIPTION OF THE EMBODIMENTS

Figure 1:
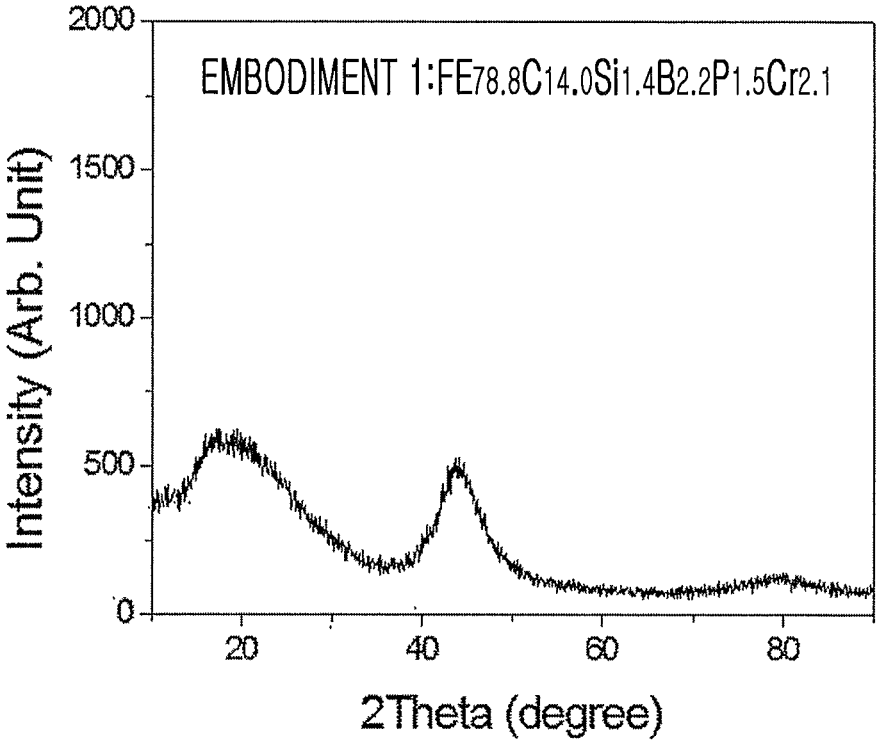
FIG. 1 is a graph illustrating results of X-ray diffraction of a high carbon iron-based amorphous alloy manufactured according to a first exemplary embodiment of the present invention.
Figure 2:
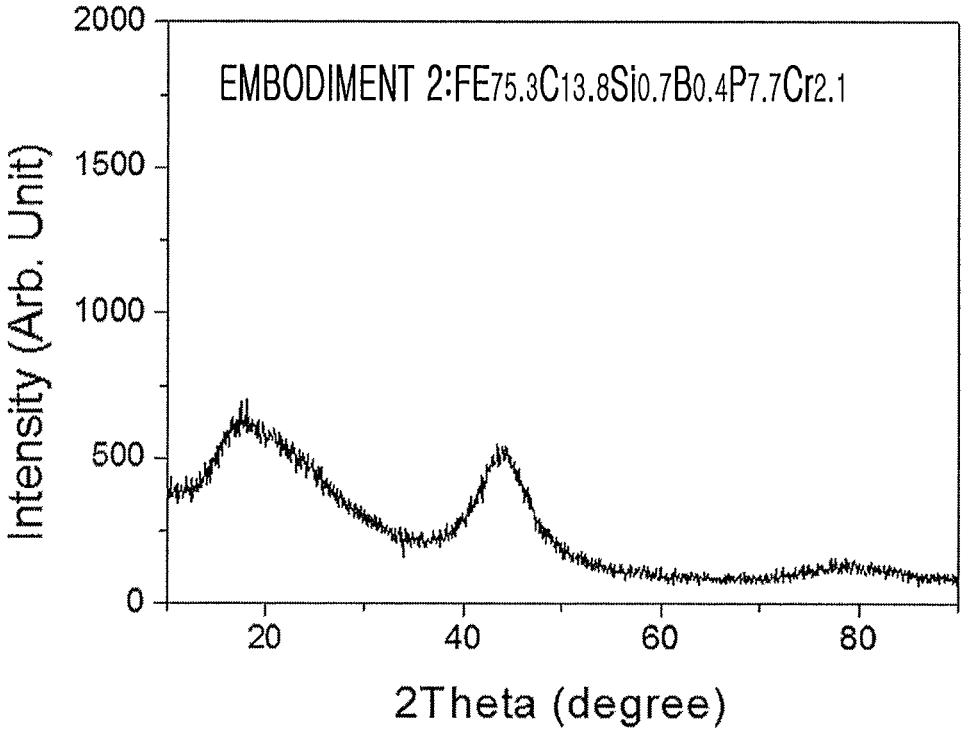
FIG. 2 is a graph illustrating results of X-ray diffraction of a high carbon iron-based amorphous alloy manufactured according to a second exemplary embodiment of the present invention.
Figure 3:
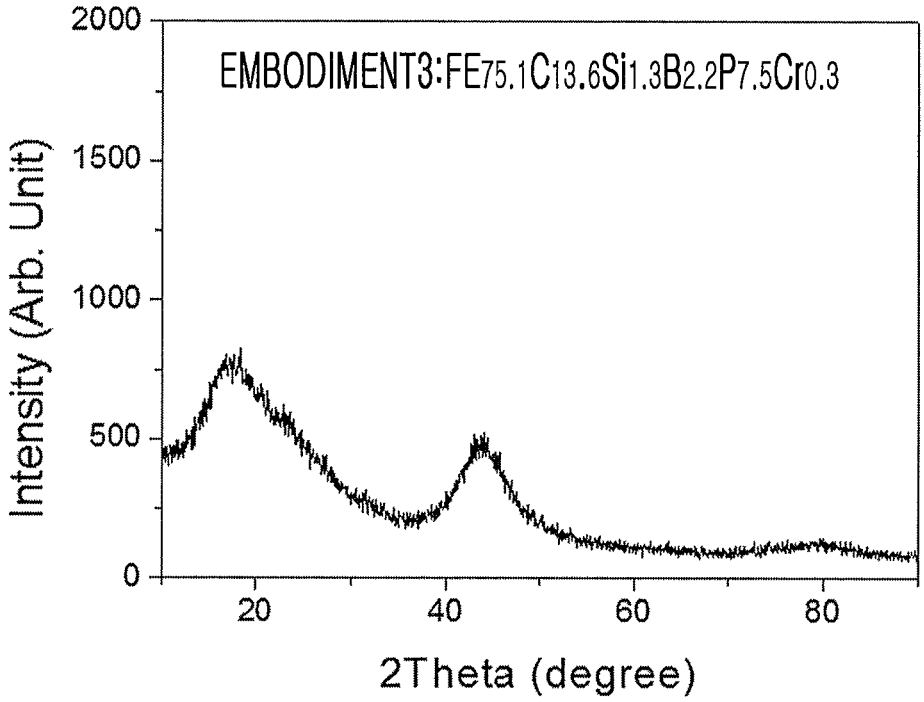
FIG. 3 is a graph illustrating results of X-ray diffraction of a high carbon iron-based amorphous alloy manufactured according to a third exemplary embodiment of the present invention.
Figure 4:
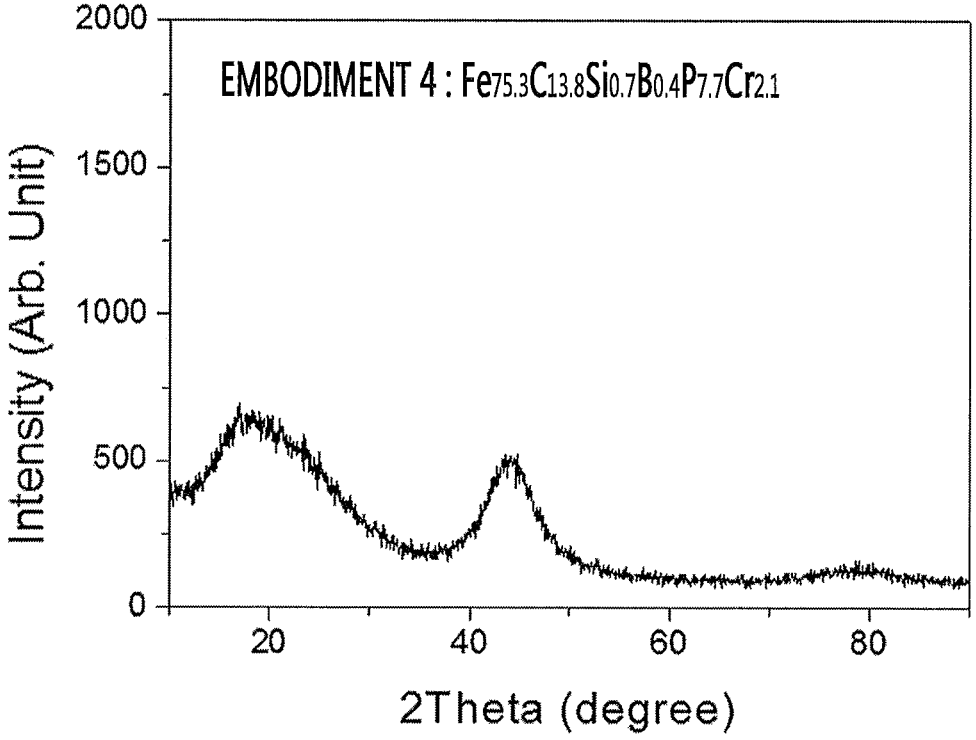
FIG. 4 is a graph illustrating results of X-ray diffraction of a high carbon iron-based amorphous alloy manufactured according to a fourth exemplary embodiment of the present invention.
Figure 5:
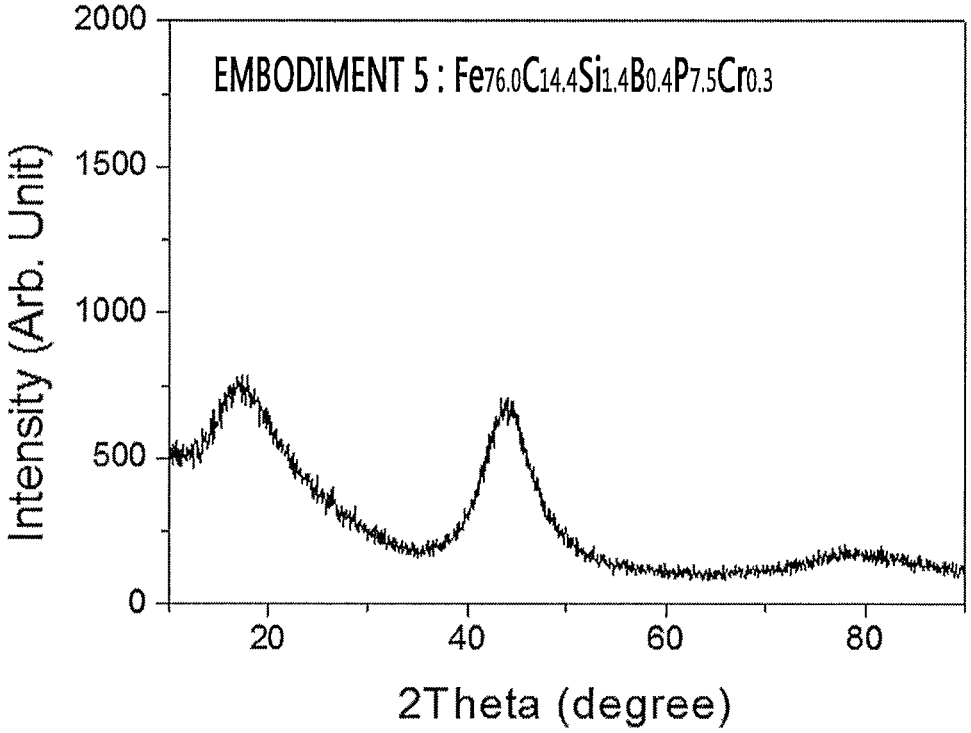
FIG. 5 is a graph illustrating results of X-ray diffraction of a high carbon iron-based amorphous alloy manufactured according to a fifth exemplary embodiment of the present invention.
Figure 6:
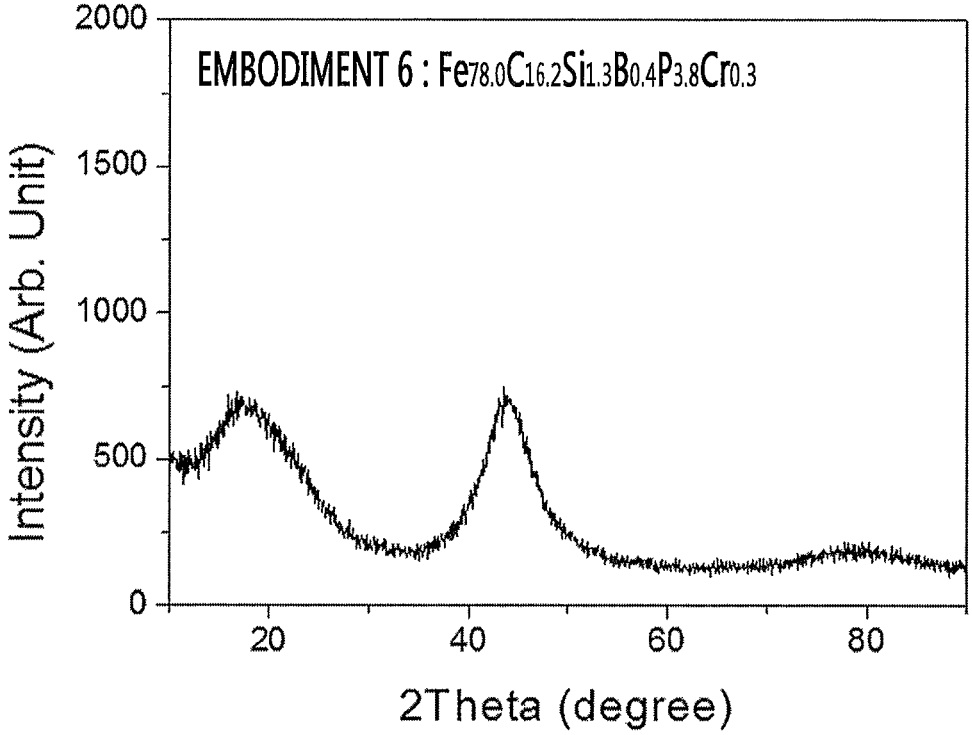
FIG. 6 is a graph illustrating results of X-ray diffraction of a high carbon iron-based amorphous alloy manufactured according to a sixth exemplary embodiment of the present invention.
Figure 7:
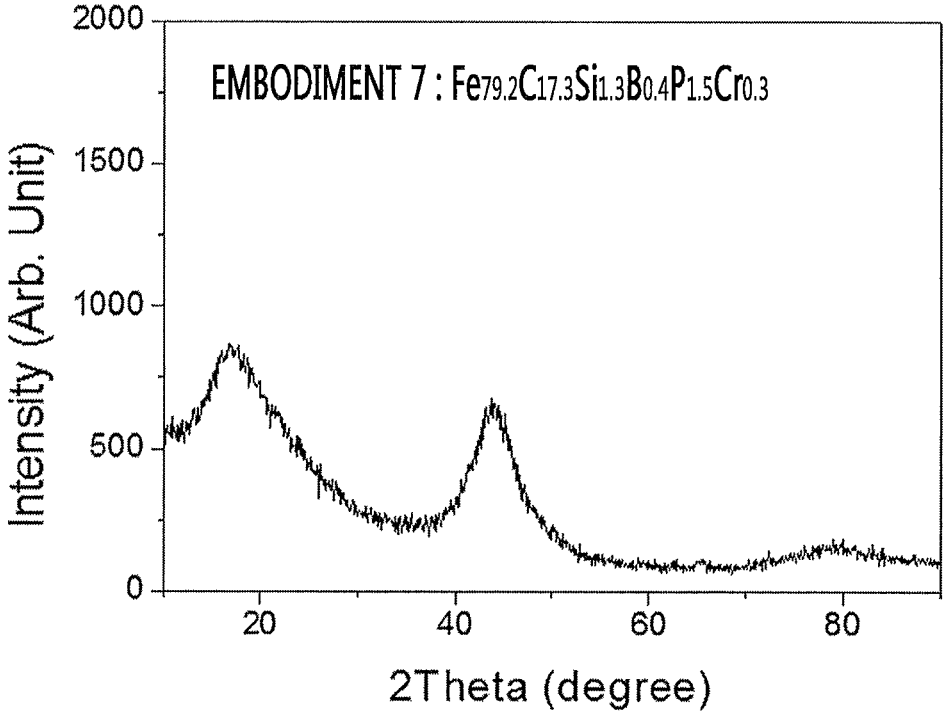
FIG. 7 is a graph illustrating results of X-ray diffraction of a high carbon iron-based amorphous alloy manufactured according to a seventh exemplary embodiment of the present invention.
Figure 8:
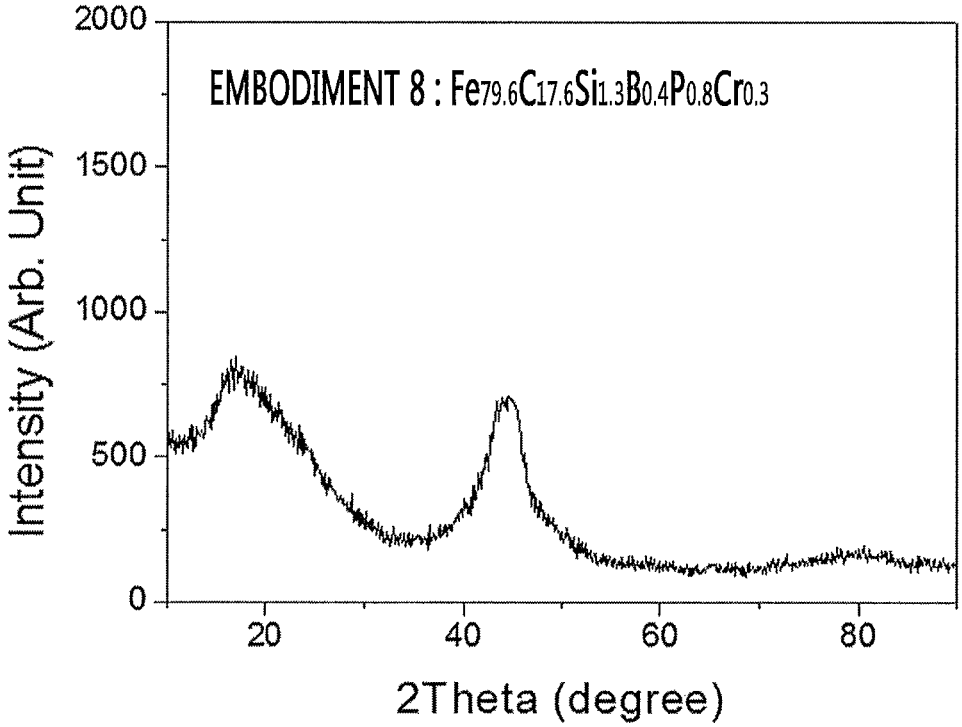
FIG. 8 is a graph illustrating results of X-ray diffraction of a high carbon iron-based amorphous alloy manufactured according to an eighth exemplary embodiment of the present invention.

The terms used in the following description are not intended to limit the present invention, but, are merely used to describe the specific exemplary embodiment(s) of the invention. It is to be understood that the singular forms include plural referents unless the context clearly dictates otherwise. The terms "comprising," "having," "including," and "containing" used herein are to define a specific feature, region, integer, steps, operations, elements and/or components, but does not exclude presence and addition of other features, regions, integers, steps, operations, elements, components, and/or groups.

Unless defined otherwise, all technical and scientific terms used herein have the same meaning as commonly understood by one of ordinary skill in the art to which this invention belongs. Unless defined otherwise, the terms defined in usual dictionaries have the same meaning used in related technical documents and herein but are not understood as ideal meanings and very official meanings.

Hereinafter, exemplary embodiments according to the present invention will be described in detail. The exemplary embodiments according to the invention are provided for the purpose of explaining the principles of the invention but do not limit the present invention.

An iron-based amorphous alloy composite according to an exemplary embodiment of the present invention is expressed by a general chemical formula $Fe_{\alpha}C_{\beta}Si_{\gamma}B_{x}P_{y}Cr_{z}$, where α, β, γ, x, y, and z indicate atomic % of iron (Fe), carbon (C), silicon (Si), boron (B), phosphorus (P) and chrome (Cr) respectively, and preferably a is expressed by $\alpha=100-(\beta+\gamma+x+y+z)$ atomic %, $\beta$ is expressed by 13.5 atomic %$\leq\beta\leq$17.8 atomic %, $\gamma$ is expressed by 0.30 atomic %$\leq\gamma\leq$1.50 atomic %, x is expressed by 0.1 atomic %$\leq x\leq$4.0 atomic %, y is expressed by 0.8 atomic %$\leq y\leq$7.7 atomic %, and z is expressed by 0.1 atomic %$\leq z\leq$3.0 atomic %.

Hereinafter, the reason for restricting atomic % of each component of the amorphous alloy according to an exemplary embodiment of the present invention will described.

First, carbon (C) and silicon (Si) are preferably 13.5 atomic % to 17.8 atomic % and 0.30 atomic % to 1.50 atomic % respectively. As such, the reason of restricting carbon (C) and silicon (Si) is to utilize molten pig iron produced at an integrated steel mill during the iron making process as it is in the exemplary embodiment of the present invention.

The molten pig iron mass-produced by a blast furnace at an integrated steel mill consists of iron (Fe), carbon (C), silicon (Si), and phosphorus (P) and concentrations of the respective components are as follows. That is, iron (Fe) is contained by 80.4 atomic %$\leq$Fe$\leq$85.1 atomic %, carbon (C) is 13.5 atomic %$\leq$C$\leq$17.8 atomic %, silicon (Si) is 0.3 atomic %$\leq$Si$\leq$1.5 atomic %, phosphorus (P) is 0.2 atomic %$\leq$P$\leq$0.3 atomic %.

Therefore, in an exemplary embodiment of the present invention, as much as possible of the molten pig iron as a main raw material of the iron-based amorphous alloy can be used.

Next, phosphorus (P) will be described. Since phosphorus (P) is contained in the molten pig iron produced by the blast furnace by a low concentration, phosphorus (P) is hard to be formed as amorphous during the quenching. Therefore, in order for phosphorus (P) to be amorphous, more predetermined concentration of the phosphorus (P) should be controlled. However, when phosphorus (P) is added too much, manufacturing costs of the amorphous alloy increase. Therefore, concentration of phosphorus (P) is preferably controlled by 0.8 atomic % to 7.7 atomic % so as to maintain excellent glass forming ability even at minimum threshold concentration and to form amorphousness.

Next, boron (B) will be described. Boron (B) is controlled by an amount needed to form amorphousness in an iron-based alloy but excessive amount of boron (B) brings increase of manufacturing costs of an amorphous alloy. Therefore, concentration of boron (B) is preferably controlled by 0.1 atomic % to 4.0 atomic % with minimum threshold concentration so as to maintain excellent glass forming ability and to form amorphousness.

Next, chrome (Cr) will be described. Concentration of chrome (Cr) is preferably controlled by 0.1 atomic % to 3.0 atomic % so as to form amorphousness and particularly to improve corrosion resistance. In order to form amorphousness and to improve corrosion resistance, concentration of chrome (Cr) is controlled to as much as possible up to an upper limit 3 atomic %. The reason of restricting limiting the upper limit of the concentration of chrome (Cr) is because chrome (Cr) is added in the form of Fe—Cr alloy iron which is expensive and has high melting point so that a large amount of energy is needed and this is disadvantageous in economical view.

Hereinafter, a method of manufacturing an iron-based amorphous alloy according to an exemplary embodiment of the present invention will be described.

The iron-based amorphous alloy according to an exemplary embodiment of the present invention is manufactured by utilizing molten pig iron produced by a blast furnace as a base alloy.

First, the molten pig iron produced by a blast furnace of a steel mill is received in a torpedo car or a ladle and is added with an alloy iron to have a composition proper to produce an iron-based amorphous alloy.

The prepared molten pig iron preferably contains iron (Fe) of 80.4 atomic %$\leq$Fe$\leq$85.1 atomic %, carbon (C) of 13.5 atomic %$\leq$C$\leq$17.8 atomic %, silicon (Si) of 0.3 atomic %$\leq$Si$\leq$1.5 atomic %, and phosphorus (P) of 0.2 atomic %$\leq$P$\leq$0.3 atomic %.

In order for the prepared molten pig iron to have the composition of the amorphous alloy according to an exemplary embodiment of the present invention, silicon (Si) is added with Fe—Si alloy, boron (B) is added with Fe—B alloy, phosphorus (P) is added with Fe—P alloy, and chrome (Cr) is added with Fe—Cr alloy by weighing. In this case, boron (B) of the added Fe—B alloy and phosphorus (P) of the added Fe—B alloy decrease melting temperature of the molten pig iron and delay crystallization during the quenching to improve glass forming ability. Moreover, chrome (Cr) of the added Fe—Cr alloy improves the produced corrosion resistance of amorphous alloy.

The respective alloy irons added into the molten pig iron are melted by sensible heat. The molten pig iron added with alloy irons may be inserted into a tundish and may be injected with gas such as pure oxide, oxide mixture, air or solid oxide such as iron oxide and manganese oxide.

Moreover, in order to control temperature of the molten pig iron in the tundish, temperature of molten metal is optimized using a temperature increasing device provided in the tundish. If necessary, an inert gas such as nitride or argon gas provided in the lower side of the tundish may be injected to generate bubbling and to improve melting and alloying efficiency of the alloy iron. The molten metal prepared as described above may be used as liquid or may be quenched in a mold and may be melted in a crucible again.

Next, a method of manufacturing an amorphous alloy will be described with an example of manufacturing of an amorphous alloy using the molten metal as liquid is.

When an amorphous alloy is manufactured in bulk, molten metal is poured into a mold and is rapidly quenched at quenching rate of at least 100° C./sec. Moreover, when an amorphous alloy is manufactured in the form of a ribbon, prepared molten metal is fed onto a surface of a single role or surfaces of twin roles rotating at high speed using a melt spinning apparatus and is rapidly quenched at least quenching rate of 100° C./sec. Here, the well-known melt spinning apparatus may be used and its description will be omitted.

As described above, an amorphous alloy according to an exemplary embodiment of the present invention may be manufactured in an amorphous alloy ribbon by a rapid quenching such as melt spinning, in bulk by the rapid quenching, or in powder by atomizing. If amorphous powder is manufactured by atomizing, firstly powder may be manufactured, preforms may be fabricated using the powder, and the preforms may be applied with high pressure at high temperature to be formed into amorphous parts in bulk while maintaining amorphous structure.

Hereinafter, the present invention will be described in more detail by an experimental example. The experimental example is provided only to illustrate the present invention but the present invention is not limited thereto.

EXPERIMENTAL EXAMPLE

First, high carbon molten pig iron produced by a blast furnace at an integrated steel mill is injected into a ladle. Next, Fe—P alloy iron, Fe—B alloy iron, Fe—Si alloy iron, and Fe—Cr alloy iron are added into the ladle. In this case, the respective added alloy irons are melted by sensible heat of the molten pig iron.

Then, loss of oxidation of alloys is minimized by carbon in the molten pig iron. Next, the molten pig iron in the ladle is injected in to the tundish and oxide iron and manganese oxide are poured while taking oxide mixture to control concentration of carbon.

The temperature-increasing apparatus is driven to assist melting of the alloy iron and to optimize temperature of the molten metal and argon gas is taken from the lower side of the tundish to generate bubbling. Composition of the molten pig iron prepared as described above is as listed in Table 1.

Next, the prepared molten pig iron is injected into a crucible provided in the melt spinning apparatus and the molten pig iron in the crucible is fed onto the surface of a single role of the melt spinning apparatus rotating at high speed. The molten pig iron fed onto the surface of the single role is rapidly quenched and is manufactured into a ribbon specimen with a width about 0.5-1.3 mm and thickness of 20-35 mm.

At this time, the quenching conditions in the first to eighth exemplary embodiments and the comparative examples 1 and 2 are identical to each other.

Crystallization of the specimens fabricated as described above is measured by an X-ray diffractometer. The results of the X-ray diffraction of the alloys manufactured to have compositions as described in the measured first to eighth exemplary embodiments and the comparative examples 1 and 2 are illustrated in FIGS. 1 to 10.

TABLE 1

| | Composition formula (atomic %) | Amorphous? |
|---|---|---|
| exemplary embodiment 1 | $Fe_{78.8}C_{14.0}Si_{1.4}B_{2.2}P_{1.5}Cr_{2.1}$ | ○ |
| exemplary embodiment 2 | $Fe_{75.3}C_{13.8}Si_{0.7}B_{0.4}P_{7.7}Cr_{2.1}$ | ○ |
| exemplary embodiment 3 | $Fe_{75.1}C_{13.6}Si_{1.3}B_{2.2}P_{7.5}Cr_{0.3}$ | ○ |
| exemplary embodiment 4 | $Fe_{75.3}C_{13.8}Si_{0.7}B_{0.4}P_{7.7}Cr_{2.1}$ | ○ |
| exemplary embodiment 5 | $Fe_{76.0}C_{14.4}Si_{1.4}B_{0.4}P_{7.5}Cr_{0.3}$ | ○ |
| exemplary embodiment 6 | $Fe_{78.0}C_{16.2}Si_{1.3}B_{0.4}P_{3.8}Cr_{0.3}$ | ○ |
| exemplary embodiment 7 | $Fe_{79.2}C_{17.3}Si_{1.3}B_{0.4}P_{1.5}Cr_{0.3}$ | ○ |
| exemplary embodiment 8 | $Fe_{79.6}C_{17.6}Si_{1.3}B_{0.4}P_{0.8}Cr_{0.3}$ | ○ |
| Comparative Example 1 | $Fe_{82.5}C_{13.1}Si_{2.0}B_{0.6}P_{1.5}Cr_{0.3}$ | X |
| Comparative Example 2 | $Fe_{84.6}C_{12.4}Si_{0.7}B_{0.4}P_{1.6}Cr_{0.3}$ | X |

As illustrated in FIGS. 1 to 8, it is understood that, as a result of the X-ray diffraction for Fe—C—Si—P—B—Cr-based (iron-based), alloy manufactured with composition according to the first to eighth exemplary embodiments, none of diffraction peak is observed but only broad halo pattern near a diffraction angle as two theta of 42 degrees is observed. From the results of X-ray diffraction, it is understood that all alloys manufactured with the compositions as described in the first to eighth exemplary embodiments have an amorphous structure.

Figure 9:
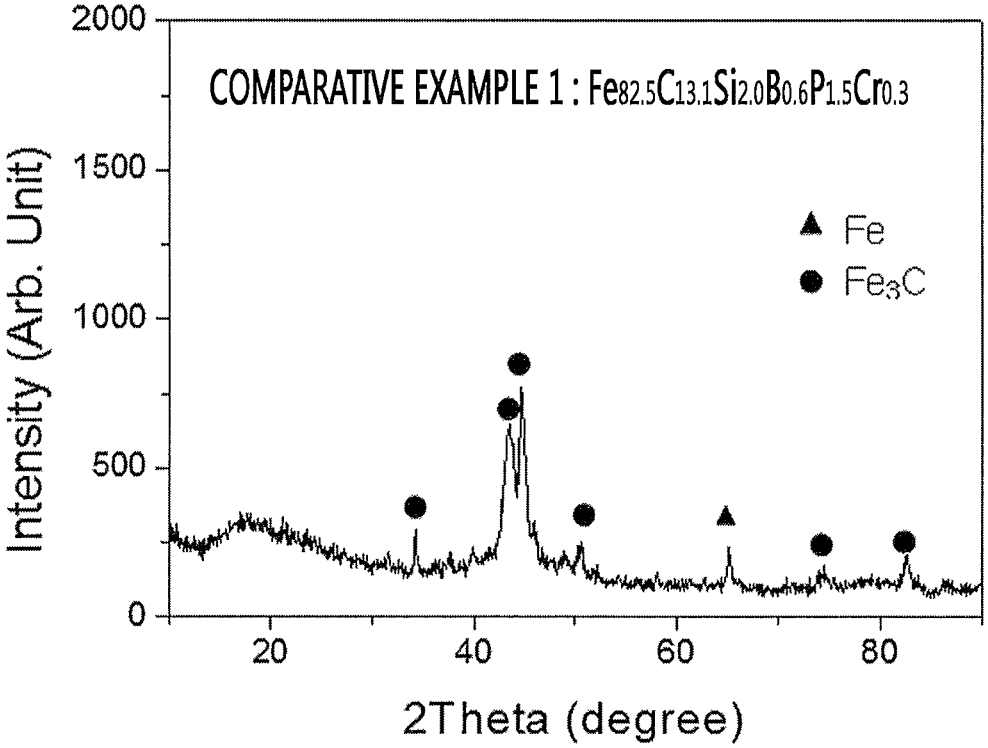
FIG. 9 is a graph illustrating results of X-ray diffraction of a high carbon iron-based amorphous alloy manufactured according to a first comparative example of the present invention.
Figure 10:
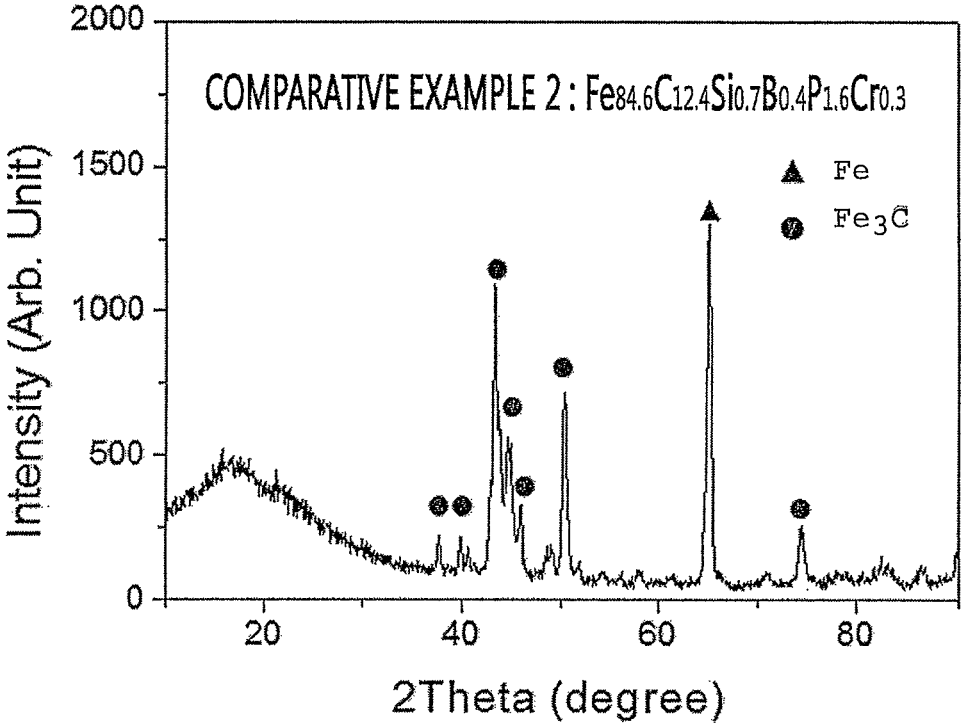
FIG. 10 is a graph illustrating results of X-ray diffraction of a high carbon iron-based amorphous alloy manufactured according to a second comparative example of the present invention.

However, as seen from FIGS. 9 and 10, from the results of X-ray diffraction for Fe—C—Si—P—B—Cr-based alloys manufactured with the compositions as described in the comparative examples 1 and 2, a diffraction peak of crystals is observed from crystals so that the alloys have a crystalline structure. These results are because carbon (C) and silicon (Si) are controlled under a range lower than an optimized range as described in the present invention and do not meet the threshold concentration for forming amorphousness.

Moreover, according to the first to eighth exemplary embodiments, the manufactured alloys can maintain the amorphousness even when the added amount of boron (B) is small within 0.1 to 4.0 atomic % and the manufactured alloys have amorphousness even when phosphorus (P) of a relative low range 0.8 to 7.7 atomic % is added.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A high carbon iron-based amorphous alloy expressed by a general formula $Fe_{\alpha}C_{\beta}Si_{\gamma}B_{x}P_{y}Cr_{z}$, wherein α, β, γ, x, y and z are atomic % of iron (Fe), carbon (C), silicon (Si), boron (B), phosphorus (P), and chrome (Cr) respectively, wherein α is expressed by $\alpha=100-(\beta+\gamma+x+y+z)$ atomic %, β is expressed by 13.5 atomic %≤β≤17.8 atomic %, γ is expressed by 0.30 atomic %≤γ≤1.50 atomic %, x is expressed by 0.1 atomic %≤x≤4.0 atomic %, y is expressed by 0.8 atomic %≤y≤7.7 atomic %, and z is expressed by 0.1 atomic %≤z≤3.0 atomic %.

2. The high carbon iron-based amorphous alloy of claim 1, wherein:

the high carbon iron-based amorphous alloy is manufactured using molten pig iron produced by a blast furnace of an iron making process in a steel mill.

3. The high carbon iron-based amorphous alloy of claim 2, wherein: the molten pig iron has content of carbon (C) of at least 13.5 atomic %.

4. The high carbon iron-based amorphous alloy of claim 3, wherein:

the molten pig iron contains iron (Fe) of 80.4 atomic %≤Fe≤85.1 atomic %, carbon (C) of 13.5 atomic %≤C≤17.8 atomic %, silicon (Si) of 0.3 atomic %≤Si≤1.5 atomic %, phosphorus (P) of 0.2 atomic %≤P≤0.3 atomic %.

5. The high carbon iron-based amorphous alloy of claim 2, wherein:

the molten pig iron contains iron (Fe) of 80.4 atomic %≤Fe≤85.1 atomic %, carbon (C) of 13.5 atomic %≤C≤17.8 atomic %, silicon (Si) of 0.3 atomic %≤Si≤1.5 atomic %, phosphorus (P) of 0.2 atomic %≤P≤0.3 atomic %.

6. The high carbon iron-based amorphous alloy of claim 1, wherein:

the high carbon iron-based amorphous alloy is any one of a ribbon shape, bulk, and powder.

* * * * *